US012796889B2

(12) United States Patent
Friedke et al.

(10) Patent No.: US 12,796,889 B2
(45) Date of Patent: Nov. 17, 2026

(54) DOMESTIC DISHWASHER

(71) Applicant: BSH Hausgeräte GmbH, Munich (DE)

(72) Inventors: Aaron Friedke, Gundelfingen (DE); Manuel Jörg, Lauingen (DE); Daniel Miller, Dillingen (DE); Michael Rupp, Holzheim (DE); Stephan Lange, Neu-Ulm (DE)

(73) Assignee: BSH Hausgeräte GmbH, Munich (DE)

( * ) Notice: Subject to any disclaimer, the term of this patent is extended or adjusted under 35 U.S.C. 154(b) by 141 days.

(21) Appl. No.: 18/836,373

(22) PCT Filed: Jan. 13, 2023

(86) PCT No.: PCT/EP2023/050743
§ 371 (c)(1),
(2) Date: Aug. 7, 2024

(87) PCT Pub. No.: WO2023/165751
PCT Pub. Date: Sep. 7, 2023

(65) Prior Publication Data

US 2025/0169673 A1 May 29, 2025

(30) Foreign Application Priority Data

Mar. 3, 2022 (DE) ..... 102022202167.3

(51) Int. Cl.
*A47L 15/50* (2006.01)

(52) U.S. Cl.
CPC ..... *A47L 15/507* (2013.01)

(58) Field of Classification Search
CPC ..... A47L 15/507
See application file for complete search history.

(56) References Cited

U.S. PATENT DOCUMENTS

| | | | |
|---|---|---|---|
| 2008/0210272 | A1 | 9/2008 | Kaczmarek |
| 2008/0315739 | A1 | 12/2008 | Hirano |
| 2018/0177380 | A1 | 6/2018 | Wilson |

FOREIGN PATENT DOCUMENTS

| | | | | |
|---|---|---|---|---|
| CN | 108272425 A | | 7/2018 | |
| DE | 102016225807 A1 | | 6/2018 | |
| KR | 20060001155 A | * | 1/2006 | ..... A47L 15/507 |

OTHER PUBLICATIONS

Machine Translation of Lim, KR-20060001155-A, Jan. 2006. (Year: 2006).*
National Search Report DE 10 2022 202 167.3 dates Nov. 8, 2022.

* cited by examiner

*Primary Examiner* — David G Cormier
(74) *Attorney, Agent, or Firm* — Michael E. Tschupp; Andre Pallapies; Brandon G. Braun

(57) ABSTRACT

A household dishwasher includes a dishwasher cavity, a coupling element designed to be shifted into and at least partially out of the dishwasher cavity, a receptacle for items to be washed, with the receptacle designed to be shifted with respect to the coupling element in and against an extension direction between a retracted and extended state of the receptacle, and a drive designed to drive the coupling element in order to shift the coupling element into and out of the dishwasher cavity.

16 Claims, 9 Drawing Sheets

DOMESTIC DISHWASHER

CROSS-REFERENCES TO RELATED APPLICATIONS

This application is the U.S. National Stage of International Application No. PCT/EP2023/050743, filed Jan. 13, 2023, which designated the United States and has been published as International Publication No. WO 2023/165751 A1 and which claims the priority of German Patent Application, Serial No. 10 2022 202 167.3, filed Mar. 3, 2022, pursuant to 35 U.S.C. 119(a)-(d).

The contents of International Application No. PCT/EP2023/050743 and German Patent Application, Serial No. 10 2022 202 167.3 are incorporated herein by reference in their entireties as if fully set forth herein.

BACKGROUND OF THE INVENTION

The present invention relates to a household dishwasher.

The intention is to make it increasingly easy to operate household dishwashers (also referred to hereinafter as "dishwashers"). One aspect in this regard is that a drive retracts and extends a receptacle for items to be washed, such as for example an upper or lower basket, into and out of the dishwasher cavity of the dishwasher for loading and unloading. The intention is to improve the accessibility of the receptacle for items to be washed by extending the latter as far out of the dishwasher cavity as possible.

Publication DE 10 2005 010 616 A1 discloses a household dishwasher with a drive, which is configured to move a receptacle for items to be washed automatically out of and into the dishwasher cavity. The receptacle for items to be washed is mounted on telescopic rails and the drive is implemented by way of a toothed wheel, which engages into a toothed rack on the receptacle for items to be washed.

Publications WO 2018/120924 A1 and WO 2020/124970 A1 disclose a household dishwasher with a driven receptacle for items to be washed, which is fastened to the drive by way of a magnetic apparatus. A stationary threaded rod, which is connected to an electric motor, is provided for the drive.

Publication US 2008/0315739 A1 discloses an electrically driven warming drawer, which is configured to extend out of and retract into a carcass. A toothed rack, which is driven by a toothed wheel of a gear unit mounted on the carcass, is fastened to the warming drawer.

BRIEF SUMMARY OF THE INVENTION

Against this background, an object of the present invention consists in providing an improved household dishwasher.

Accordingly, a household dishwasher with a dishwasher cavity and a receptacle for items to be washed is provided. The household dishwasher further comprises a coupling element, which can be shifted into and at least partially out of the dishwasher cavity, wherein the receptacle for items to be washed can be shifted between a retracted and extended state of the same in and against an extension direction with respect to the coupling element. Provision is furthermore made for a drive, which is configured to drive the coupling element to shift the same into and out of the dishwasher cavity.

It is an idea of the present invention to provide a driven coupling element which can be shifted into and at least partially out of the dishwasher cavity, and a receptacle for items to be washed which can be shifted with respect to the coupling element. This increases the extension length of the receptacle for items to be washed.

The provision of the driven coupling element enables the drive to be arranged flexibly along the coupling element. As a result, the drive can advantageously be arranged at a greater distance from a door which closes the dishwasher cavity.

The "extension direction" is to be understood in particular to mean a horizontal direction in which the receptacle for items to be washed is extended.

In the present context, a "receptacle for items to be washed" is a receptacle, in particular a basket, for receiving items to be washed, such as for example plates, cups, cutlery or bowls. In particular, it can be an upper or lower receptacle for items to be washed, also known as an upper and lower dish basket, or a cutlery drawer.

In the present context a "dishwasher cavity" is a cavity in which one or several receptacles for items to be washed can be accommodated. The dishwasher cavity has a washing compartment, in which the items to be washed are cleaned and dried. The dishwasher cavity is preferably cuboid in shape.

According to one embodiment, the receptacle for items to be washed, in its extended state, is shifted so far out of the dishwasher cavity that the receptacle for items to be washed is spaced apart from the dishwasher cavity in the extension direction.

This advantageously makes it easier to access the contents of the receptacle for items to be washed.

A circumferential flange with a seal, on which the door rests in the closed state of the dishwasher cavity, is attached to the dishwasher cavity. The volume enclosed by the closed door and the dishwasher cavity is referred to in the present context as the washing compartment.

In the present context, the receptacle for items to be washed being spaced apart from the dishwasher cavity in the extension direction is preferably to be understood to mean that a rear side of the receptacle for items to be washed is spaced apart from the circumferential flange in the extension direction (also referred to hereinafter as "overextension").

According to a further embodiment, the coupling element is part of a telescopic extension, wherein the telescopic extension further has a fixed section, which is fastened to the dishwasher cavity, and a movable section, which is fastened to the receptacle for items to be washed, and the coupling element couples the fixed section to the movable section, wherein the coupling element is displaceable with respect to the fixed section and the movable section with respect to the coupling element.

In the present context, a "telescopic extension" has at least two sections, the profiles of which partially engage into one another in the transverse direction. The sections are arranged such that they are displaceable relative to one another. The telescopic extension enables a large extension length and a compact design.

As a result, the driven coupling element can advantageously enable an overextension of the receptacle for items to be washed.

A "fixed section" can be understood in particular to mean rollers or wheels, which are fastened rotatably to the inside of the dishwasher cavity.

A "fixed section" can also be understood to mean a rail, such as for example a telescopic rail, which is fastened to the inside of the dishwasher cavity.

A "movable section" can be understood in particular to mean rollers or wheels, which are fastened rotatably to the receptacle for items to be washed and are translationally displaceable with respect to the coupling element.

A "movable section" can also be understood to mean a rail, such as for example a telescopic rail. The rail is fastened to the receptacle for items to be washed and is translationally displaceable with respect to the coupling element.

According to a further embodiment, a carrier element with a gear unit is fastened to the coupling element, which gear unit has a drive side and an output side, wherein the drive side is actively connected to the fixed section so that the fixed section drives the gear unit when the coupling element is shifted in and out.

The active connection can be provided for example using a cable, a belt, such as for example a toothed belt or a V-belt, in particular however a combination of a toothed wheel and a toothed rack.

A "drive side" of the gear unit is to be understood in particular to mean a side of the gear unit which is provided for torque input into the gear unit.

An "output side" of the gear unit is to be understood in particular to mean a side of the gear unit which is provided for torque output from the gear unit.

According to a further embodiment, the output side of the gear unit is actively connected to the movable section in order to shift the receptacle for items to be washed between the retracted and extended state.

Advantageously, only one drive or motor is required to extend the receptacle for items to be washed.

As already explained above for the drive side of the gear unit, the active connection can be provided for example using a cable, a belt, such as for example a toothed belt or a V-belt, in particular however a combination of a toothed wheel and a toothed rack. The active connection is preferably designed as a continuous connection between the receptacle for items to be washed and the drive.

According to a further embodiment, the fixed section has a toothed rack, and the toothed rack engages into at least one toothed wheel of the drive side of the gear unit, and/or the carrier element has a toothed rack, and the toothed rack engages into a toothed wheel of the drive, and/or the receptacle for items to be washed has a toothed rack, which engages into at least one toothed wheel of the output side of the gear unit.

This makes it possible to achieve a form-fit torque transmission, as a result of which for example the position of the receptacle for items to be washed can be determined by way of the rotations of the motor.

According to a further embodiment, the gear unit has at least two, four or six toothed wheels, which are arranged mechanically in series.

This makes it possible to lengthen the extensibility of the receptacle for items to be washed in the extension direction.

Toothed wheels which are arranged "mechanically in series" are to be understood in particular to mean toothed wheels which are arranged one behind the other in the extension direction and engage into the front and/or into the rear toothed wheel.

The gear unit preferably has five toothed wheels. The drive-side and output-side toothed wheels preferably have a greater diameter than the toothed wheels between the drive-side and output-side toothed wheels.

According to a further embodiment, a retainer is fastened to the movable section, wherein the receptacle for items to be washed and the toothed rack are fastened to the retainer.

This advantageously enables the retainer and the toothed rack to be formed as a single part or as a single piece.

In the present context, "as a single piece" is to be understood to mean that a component is manufactured integrally in a primary forming step, such as for example casting, injection molding or extrusion.

In the present context, "as a single part" is to be understood to mean that two partner components are connected to one another in a form-fit and/or force-fit and/or material-fit manner.

According to a further embodiment, the respective shifting of the coupling element and the receptacle for items to be washed takes place simultaneously.

According to a further embodiment, the drive has an electric motor, which is arranged outside the dishwasher cavity, wherein a shaft of the motor projects into the dishwasher cavity, and the toothed wheel of the drive is fastened to the shaft.

According to a further embodiment, the carrier element has two arms, which fasten the carrier element to opposite sides of the coupling element.

On account of the preferably elongated design of the carrier element, the carrier element is fastened to two arms. This advantageously makes it possible for a bending of the carrier element to be prevented, and for the drive-side and output-side toothed wheels to disengage from the respective toothed racks of the fixed section and the receptacle for items to be washed.

According to a further embodiment, the coupling element and/or the fixed section and/or the movable section have one or respectively one rail.

Rails enable a simple horizontal guidance.

According to a further embodiment, the rails are arranged such that they can be displaced into one another telescopically.

A rail telescopic extension advantageously has a compact structure.

According to a further embodiment, the rail of the coupling element has two C-shaped profiles, which are fastened to one another back to back, wherein the profiles are connected offset with respect to one another in the longitudinal direction, wherein the opposite sides of the coupling element, to which the arms of the carrier element are fastened, are embodied at the free ends of the rail.

This results in a compact structure.

Further possible implementations of the invention also comprise combinations—not explicitly cited—of features or embodiments described above or below in respect of the exemplary embodiments. In this context, the person skilled in the art will also add individual aspects as improvements or enhancements to the respective basic form of the invention.

BRIEF DESCRIPTION OF THE DRAWINGS

Further advantageous embodiments and aspects of the invention form the subject matter of the subclaims and of the exemplary embodiments of the invention that are described below. The invention is described in greater detail below using preferred embodiments with reference to the accompanying figures, in which

DETAILED DESCRIPTION OF EXEMPLARY EMBODIMENTS OF THE PRESENT INVENTION

Figure 1:
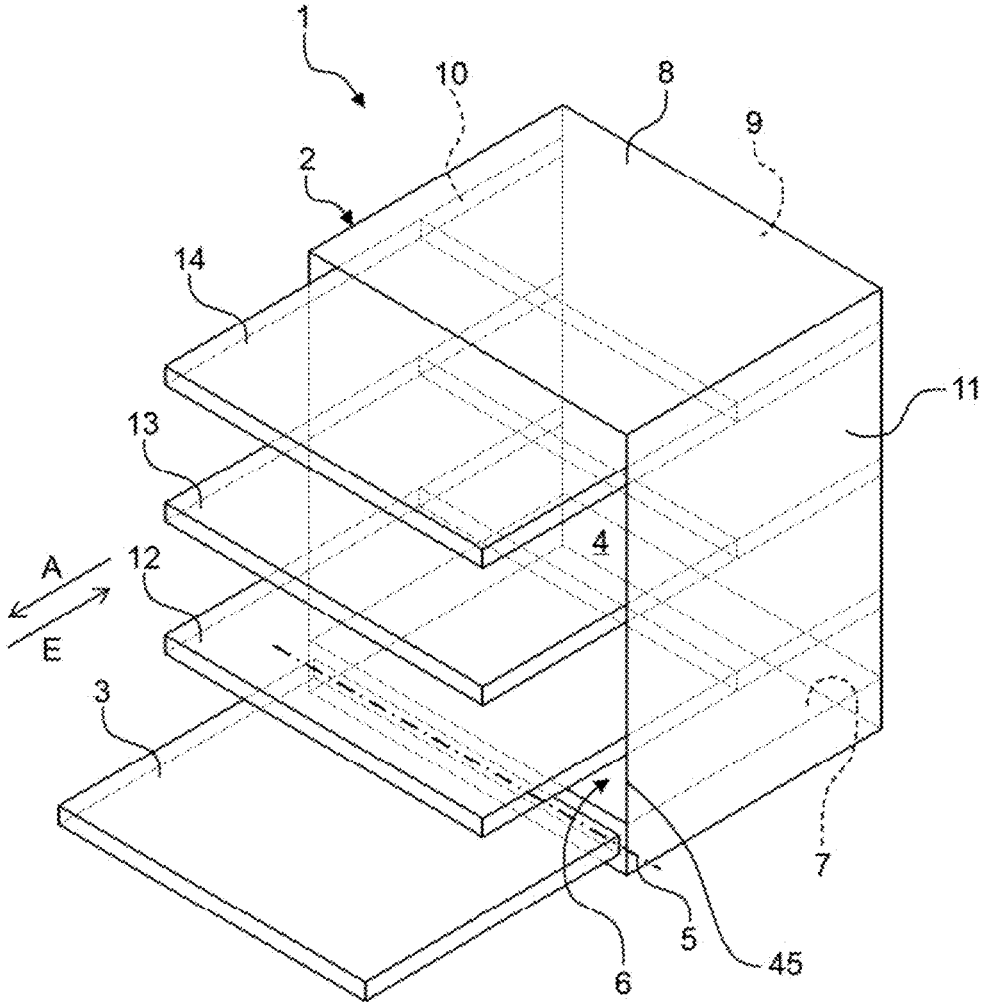
FIG. 1 shows a schematic perspective view of an embodiment of a household dishwasher.

In the figures, elements that are identical or have the same function have been provided with the same reference characters unless otherwise stated.

FIG. 1 shows a schematic perspective view of an embodiment of a household dishwasher 1. The household dishwasher 1 comprises a dishwasher cavity 2, which can be closed off by a door 3, in particular in a watertight manner. To this end, a sealing device can be provided between the door 3 and the dishwasher cavity 2. The dishwasher cavity 2 is preferably cuboid in shape. The dishwasher cavity 2 can be arranged in a housing of the household dishwasher 1. The dishwasher cavity 2 and the door 3 can form a washing compartment 4 for washing items to be washed.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a base 7, a ceiling 8 arranged opposite to the base 7, a rear wall 9 arranged opposite to the closed door 3, and two side walls 10, 11 arranged opposite to one another. The base 7, the ceiling 8, the rear wall 9 and the side walls 10, 11 can be manufactured from a stainless steel sheet, for example. Alternatively, the base 7 can be manufactured from a plastic material, for example.

The household dishwasher 1 also has at least one receptacle for items to be washed 12 to 14. A number of, for example three, receptacles for items to be washed 12 to 14 can preferably be provided, wherein the receptacle for items to be washed 12 can be a lower receptacle for items to be washed or a lower basket, the receptacle for items to be washed 13 can be an upper receptacle for items to be washed or an upper basket, and the receptacle for items to be washed 14 can be a cutlery drawer. As additionally shown in FIG. 1, the receptacles for items to be washed 12 to 14 are arranged one above the other in the dishwasher cavity 2. Each receptacle for items to be washed 12 to 14 can optionally be shifted into or out of the dishwasher cavity 2. In particular, each receptacle for items to be washed 12 to 14 can be inserted or retracted into the dishwasher cavity 2 in a retraction direction E (arrow) and extracted or extended out of the dishwasher cavity 2 against the retraction direction E (arrow) in an extension direction A (arrow).

Figure 2:
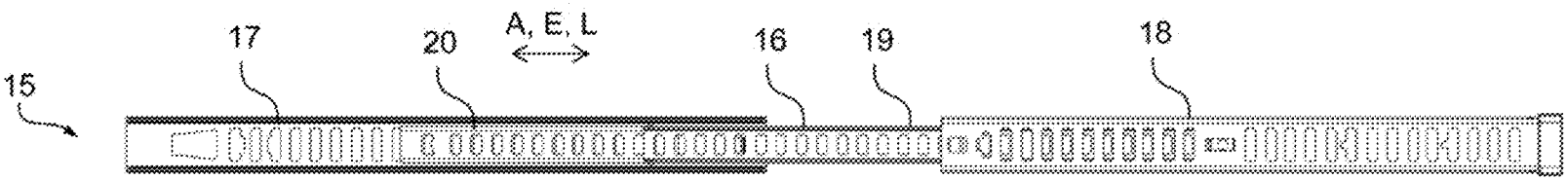
FIG. 2 shows a side view of a telescopic extension.

FIG. 2 shows an extended telescopic extension 15 with a coupling element 16, a fixed section 17 and a movable section 18. The coupling element 16 couples the fixed section 17 to the movable section 18. The fixed section 17 is fastened to the side wall 10, 11. The receptacle for items to be washed 13 is fastened to the movable section 18. The coupling element 16 is displaceable in the longitudinal direction L (double arrow) with respect to the fixed section 17. The movable section 18 is likewise displaceable in the longitudinal direction L (double arrow) (corresponding to the extension/retraction direction A (arrow), E (arrow) in FIG. 1) with respect to the coupling element 16. In the present context, the fixed section 17 and the movable section 18 are embodied as rails. The rails 17, 18 each have a C-profile. The rails 17, 18 are manufactured for example from stainless steel or a plastic material.

Instead of a rail, the fixed section 17 can be embodied for example as wheels or rollers, which are fastened rotatably to the side wall 10, 11. Instead of a rail, the movable section can be embodied for example as wheels or rollers, which are fastened rotatably to the receptacle for items to be washed 12. On the lowest receptacle for items to be washed 12, the wheels can for example be guided on the door 3 for extending and retracting the receptacle for items to be washed 12.

Figure 3:
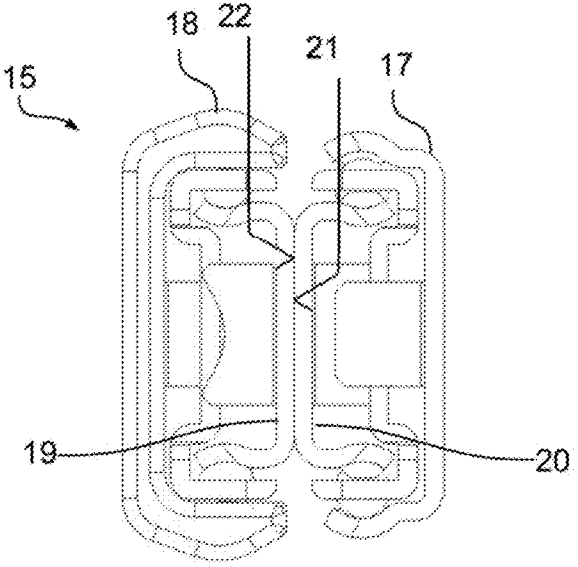
FIG. 3 shows a sectional view of the telescopic extension in a retracted state.
Figure 4:
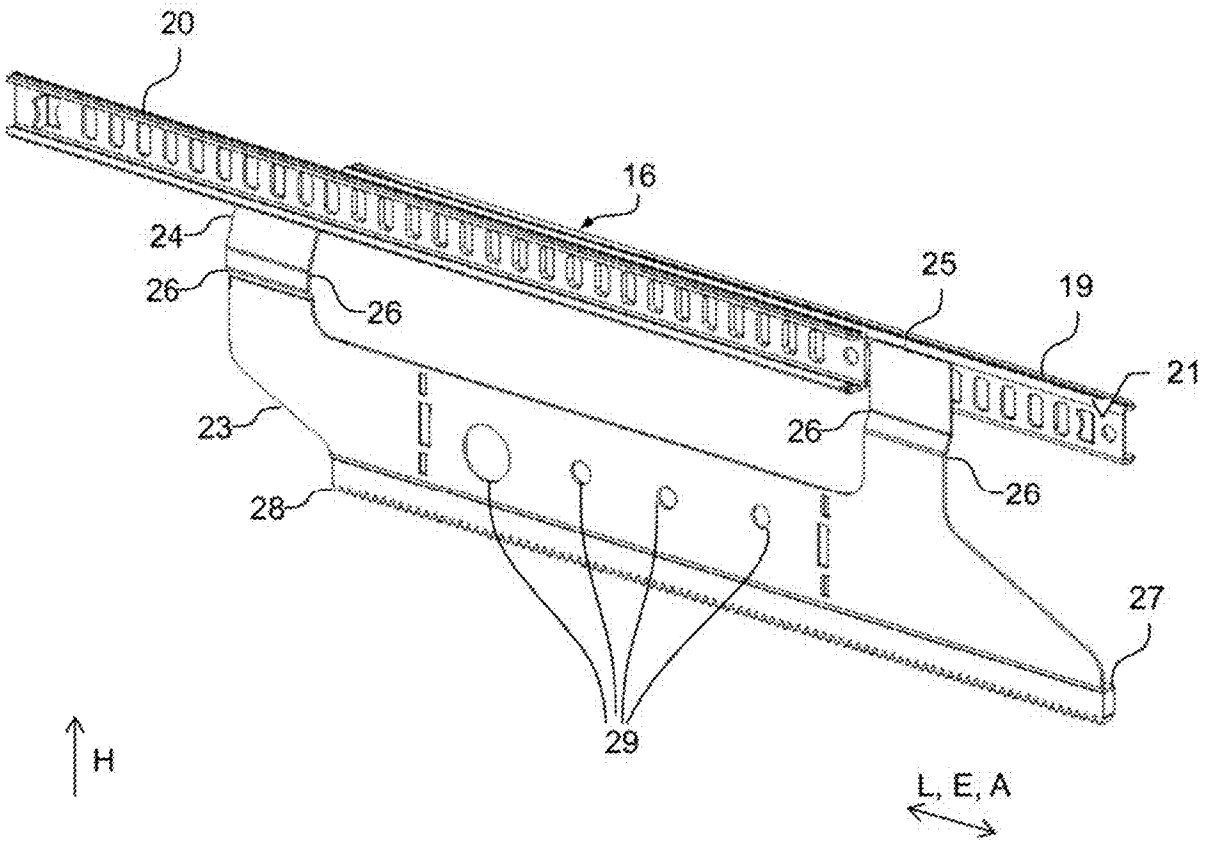
FIG. 4 shows a perspective view of a coupling element with a carrier element.

FIG. 4 illustrates the coupling element 16. The coupling element 16 has two rails 19, 20. FIG. 3 shows a cross-section of the rails 19, 20 when the telescopic extension 15 is retracted. The rails 19, 20 each have a C-profile and a rear side 21, 22. The rails 19, 20 are fastened to one another back or rear side 21 to back or rear side 22, wherein they are fastened offset with respect to one another in the longitudinal direction L (double arrow). Here, the rail 19 is fastened in front of the rail 20 in the extension direction A (arrow). As can be seen in FIG. 3, the rail 20 engages around the rail 17 so that the rail 20 is guided by the rail 17 and the rails 20, 17 can be displaced into one another. The rail 18 engages around the rail 19 so that the rail 19 is guided by the rail 18 and the rails 18, 19 can be displaced into one another. For better guidance in the longitudinal direction L (double arrow) on the rails 17, 18, the rails 19, 20 comprise for example a linear ball bearing or a slide bearing. The rails 19, 20 are manufactured for example from stainless steel or a plastic material.

FIG. 4 further shows a carrier element 23. The carrier element 23 comprises an elongated shape with a front and rear end in the longitudinal direction L (double arrow). Two arms 24, 25 are embodied at the ends on the top edge in the height direction H (arrow). The arms 24, 25 extend in the height direction H (arrow) and fasten the carrier element 23 to the coupling element 16. Here, the arm 25 is fastened to a back 21 of the free end of the rail 19. The arm 24 is fastened to the back of the free end of the rail 20. The arms 24, 25 each have for example two kinks 26 in the longitudinal direction L (double arrow). The arms 24, 25 are turned up toward the carrier element 23 along the kinks 26 such that the rails 17, 18 can be displaced freely on the coupling element 16 beyond the arms 24, 25 in the longitudinal direction L (double arrow). As a result, a collision of the arms 24, 25 with the rails 17, 18 is advantageously avoided. Furthermore, as a result, the carrier element 23 is arranged closer to the side wall 10, 11 (FIG. 1) which lies the closest opposite to the carrier element 23. This advantageously enables a compact construction.

The carrier element 23 is manufactured for example from a metal sheet or a plastic panel. At a lower end of the carrier element 23, a section 27 of the carrier element 23 is turned up. A toothed rack 28, which is driven, as explained in more detail later, is fastened to the turned-up section 27. The toothed rack 28 is manufactured for example from a plastic material. The carrier element 23 has four circular holes 29, in each of which a toothed wheel is fastened in a rotatably mounted manner, as explained in more detail later. The carrier element 23 can of course also have more or fewer than four holes 29, depending on the number of toothed wheels.

Figure 5:
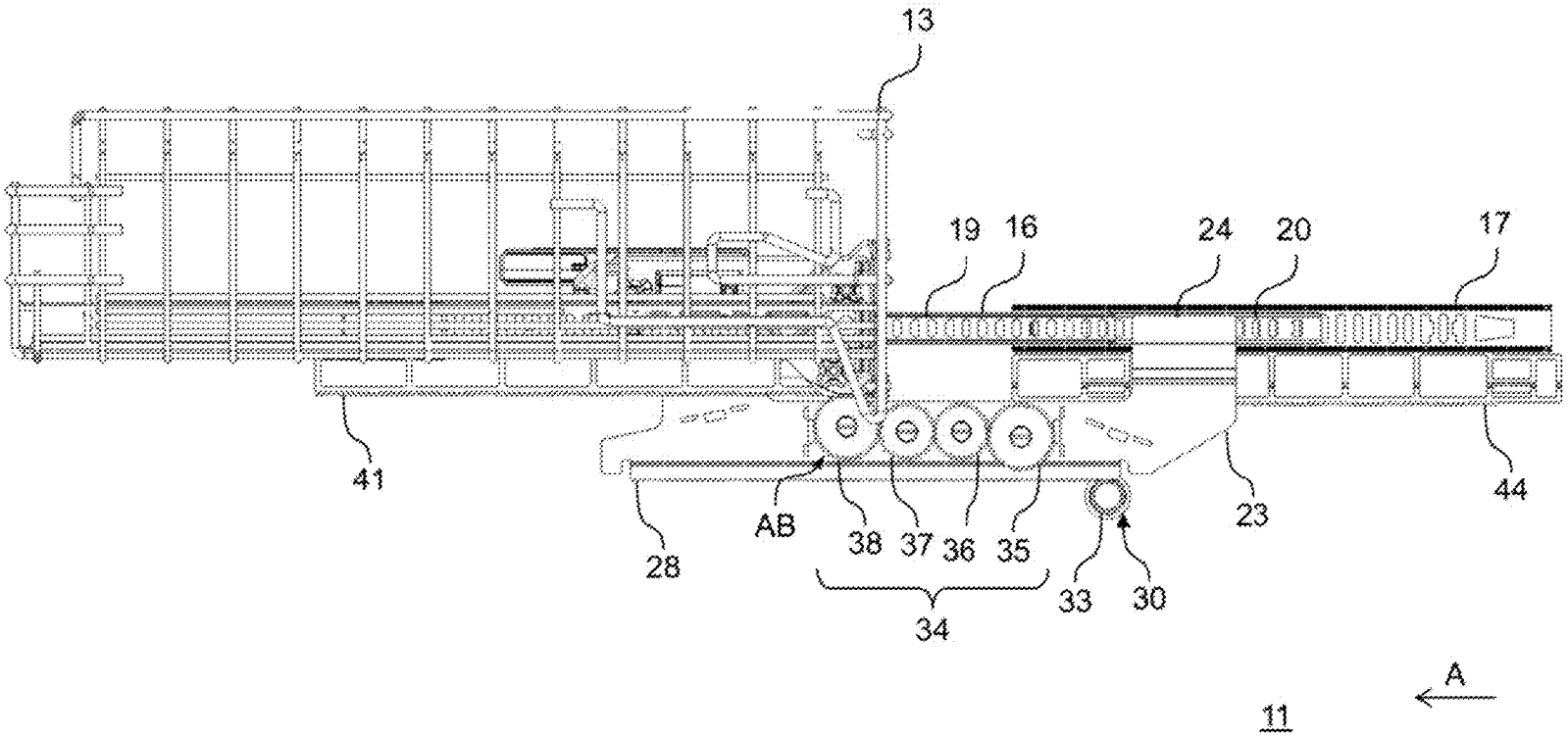
FIG. 5 shows a side view of a telescopic extension with a receptacle for items to be washed in an extended state.
Figure 6:
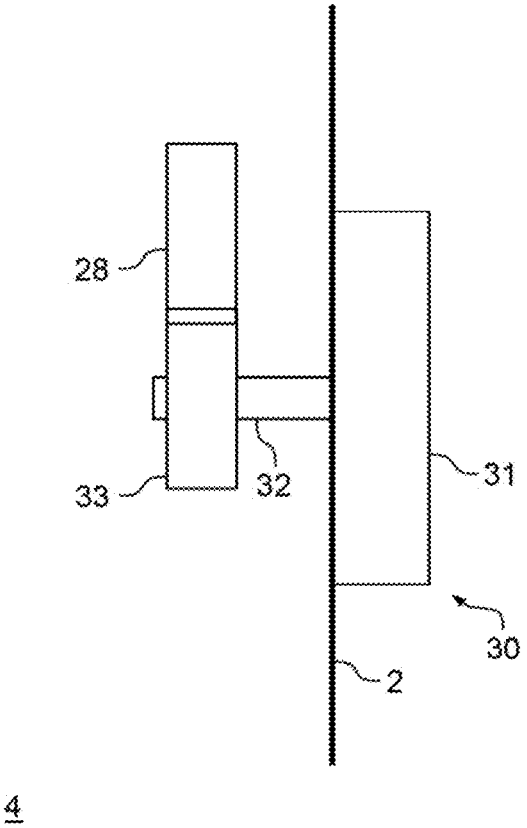
FIG. 6 shows a schematic view of a drive.

FIG. 5 shows a side view of the telescopic extension 15 with the receptacle for items to be washed 13 from FIG. 1. A drive 30 is provided for extending and retracting the receptacle for items to be washed 13 out of and into the dishwasher cavity 2. As shown in FIG. 6, the drive 30 comprises a motor 31, which is provided outside the dishwasher cavity 2, with a shaft 32, which projects into the dishwasher cavity 2. A toothed wheel in the form of a pinion 33 (also "toothed wheel" in the present context) is fastened to the shaft 32 of the motor 31. Returning to FIG. 5, the pinion 33 engages with the toothed rack 28 of the carrier element 23 and drives the carrier element 23. As a result, the coupling element 16 with the carrier element 23 is shifted into and out of the dishwasher cavity 2.

As further shown in FIG. 5, a gear unit 34 is arranged on the carrier element 23. The gear unit 34 comprises four toothed wheels 35 to 38, which are arranged one behind the other in the extension direction A (arrow). Furthermore, the toothed wheels 35 to 38 are arranged mechanically in series. In further exemplary embodiments, the gear unit 34 comprises two or six toothed wheels, which are arranged mechanically in series. The toothed wheels 35 to 38 are arranged on the side of the carrier element 23 facing away from the side wall 11. The toothed wheels 35 to 38 each engage with the toothed wheel in front. Here, the toothed wheel 35 is the rear toothed wheel in the extension direction A (arrow) and the toothed wheel 38 is the front toothed wheel in the extension direction A (arrow). The toothed wheels 35 to 38 are manufactured for example from a plastic material.

Figure 7:
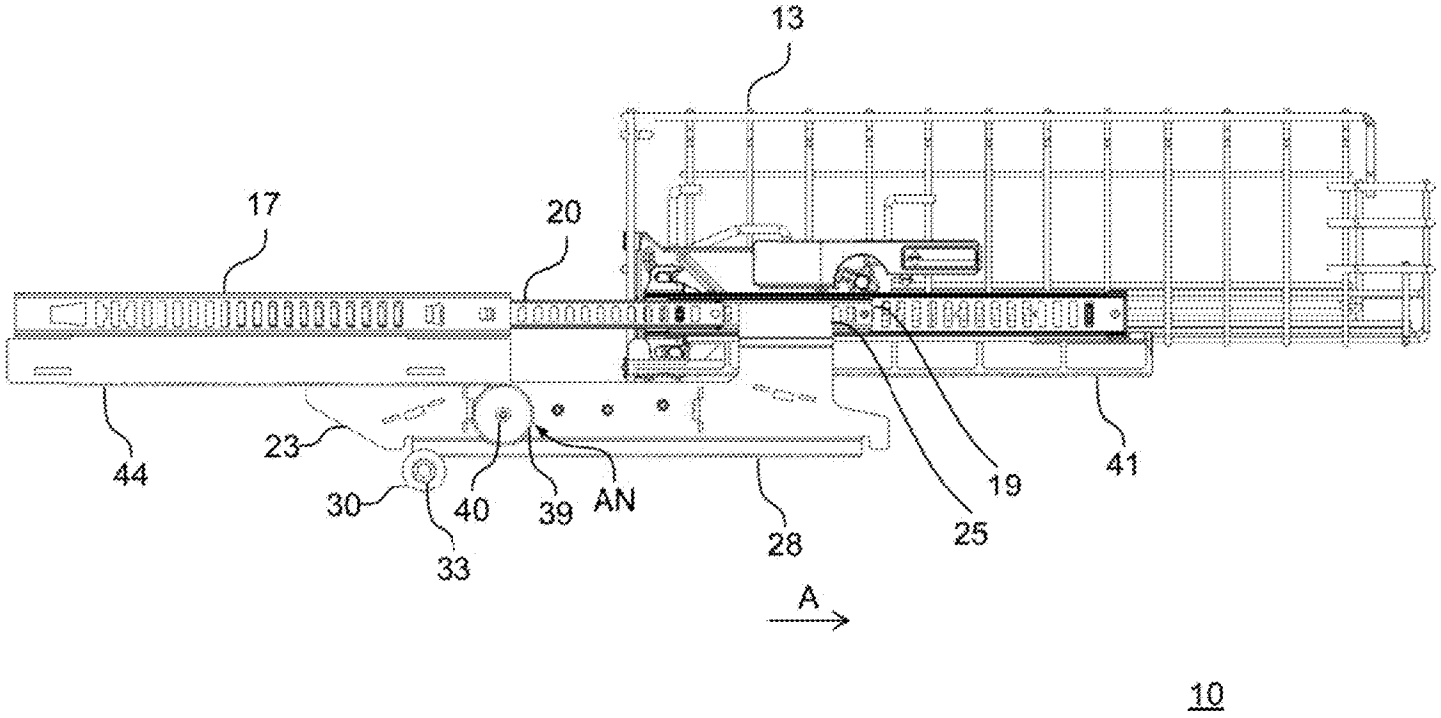
FIG. 7 shows a rear view of the telescopic extension from FIG. 5.

As illustrated in FIG. 7, the gear unit 34 comprises a further toothed wheel 39, which is provided on the side of the carrier element 23 facing toward the side wall 11. The toothed wheel 39 drives the toothed wheel 35 by way of a shaft 40. The toothed wheel 39 and the shaft 40 are manufactured for example from a plastic material. The gear unit 34 further comprises a drive side AN and an output side AB. The toothed wheel 39 is the drive-side toothed wheel AN of the gear unit 34, as explained in more detail later.

Returning to FIG. 5, it is shown that the toothed wheel 38 is the output-side toothed wheel AB of the gear unit 34. The toothed wheels 36, 37 ensure further spacing in order to increase the maximum extension length of the receptacle for items to be washed 13. In further exemplary embodiments, instead of the two toothed wheels 36, 37, more toothed wheels, for example four or six toothed wheels, can also be arranged between the rear and front toothed wheel 35, 38. With the same diameter, several toothed wheels can increase the maximum extension length of the receptacle for items to be washed 13. In order to increase the maximum extension length, it is also possible for example to increase the diameter of the toothed wheels 35 to 38. Instead of the toothed wheels 35 to 37, it is also possible for example to provide a belt drive in order to further increase the extension length. The toothed wheels 36, 37 are all optional.

Figure 10:
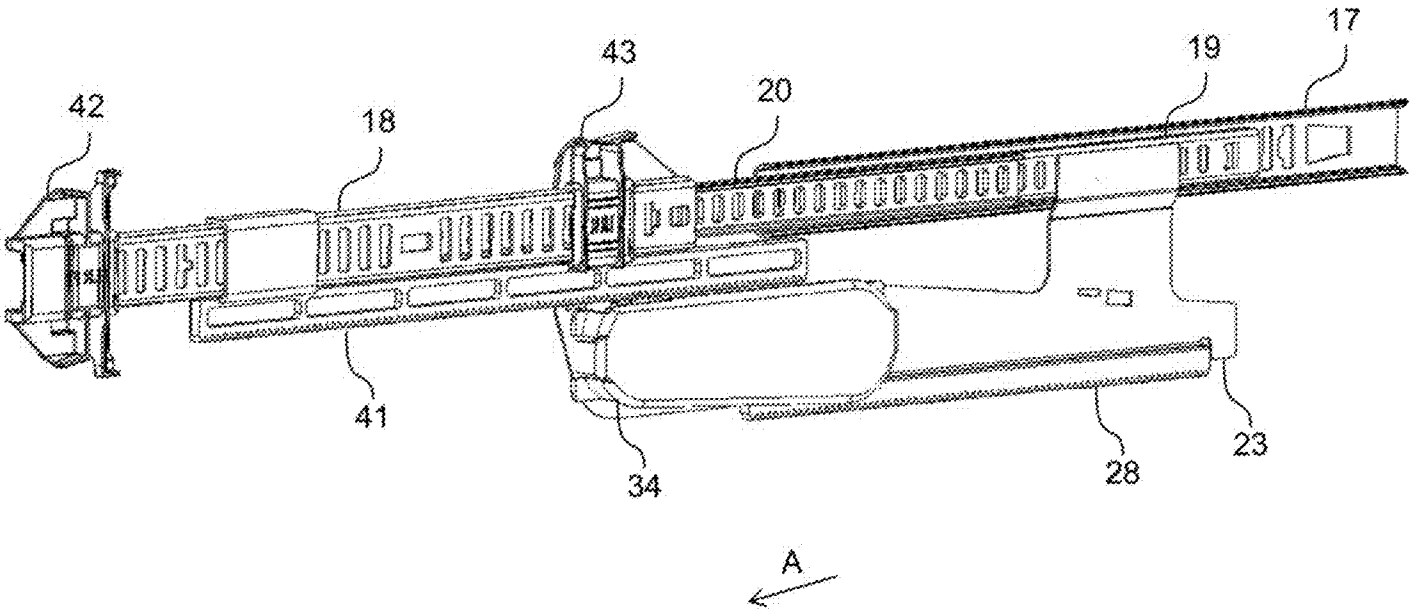
FIG. 10 shows a perspective view of a preassembled drivable telescopic extension.

As illustrated in FIG. 10, a toothed rack 41 is fastened to the rail 18. The toothed rack 41 engages with the output-side toothed wheel 38 of the gear unit 34 and drives the rail 18. As a result, the rail 18 is extended and retracted relative to the coupling element 16. The toothed rack 41 is manufactured for example from a plastic material.

Furthermore, a front and a rear retainer 42, 43 are provided on the rail 18 for fastening the receptacle for items to be washed 13 to the rail 18. The receptacle for items to be washed 13 has several rods or wires, which are clipped into the retainers 42, 43 and thereby fasten the receptacle for items to be washed 13 to the rail 18. Here, the front retainer 42 is fastened in front of the rear retainer 43 in the extension direction A (arrow). The front retainer 42 is fitted onto the front end of the rail 18 in the extension direction A (arrow). The rear retainer 43 is clipped onto the rail 18 in the rear third thereof. The rear retainer 43 is connected to the toothed rack 41. To improve stability, the toothed rack 41 is additionally clipped onto the rail 18 in the front half thereof in the longitudinal direction L (double arrow). The rear retainer 43 and the toothed rack 41 are manufactured for example as a single piece in the form of an injection-molded part made from a plastic material, but can also be manufactured in several pieces. The front and the rear retainer 42, 43 can be formed for example as a single piece with the toothed rack 41.

FIG. 7 now shows a rear view of the driven telescopic extension 15 with the receptacle for items to be washed 13. A toothed rack 44 is fastened to the rail 17. The toothed rack 44 engages with the drive-side toothed wheel 39 of the gear unit 34. The toothed wheel 39 is driven by the coupling element 16 being shifted in and out.

Figure 8:
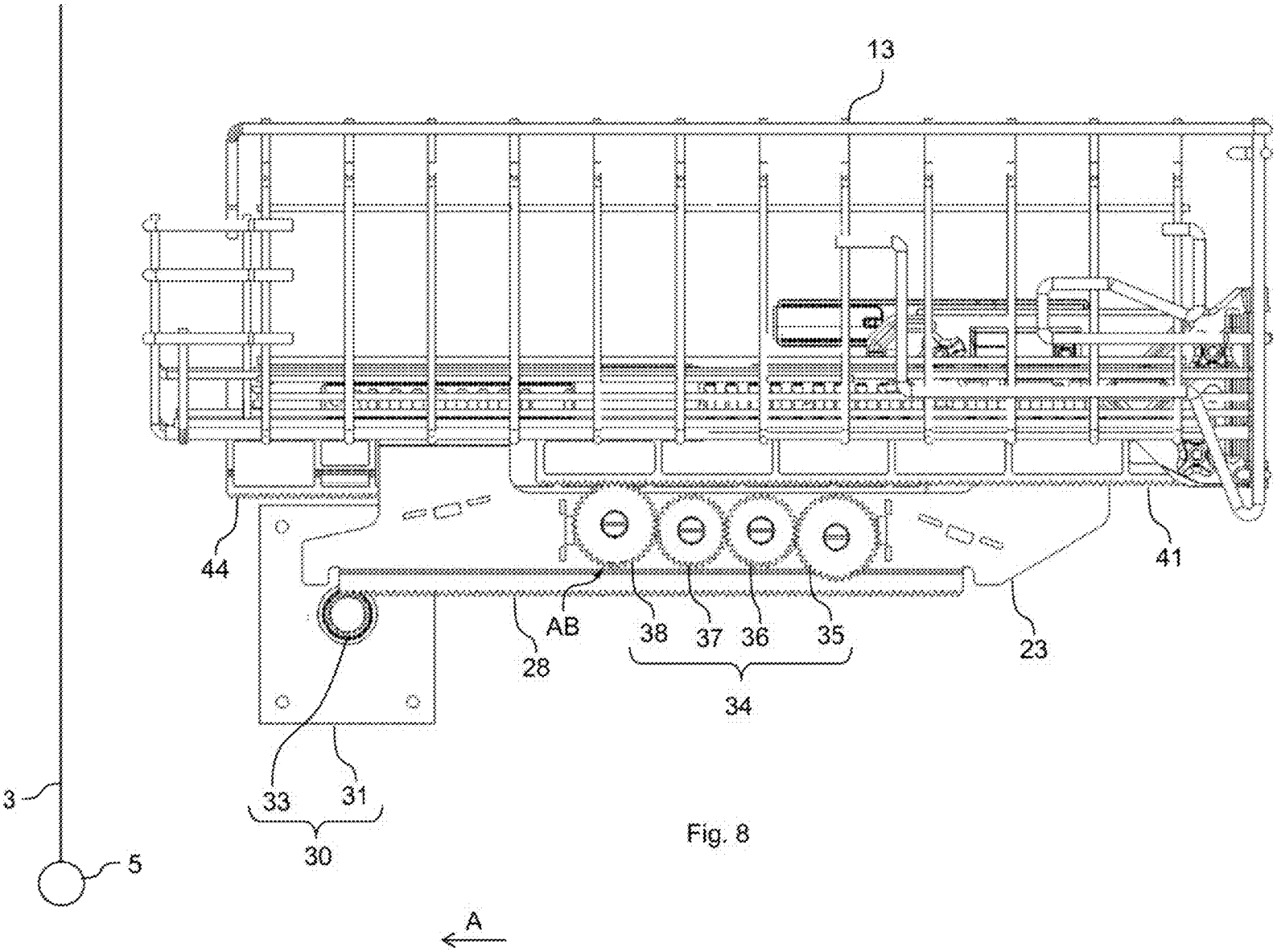
FIG. 8 shows a side view of the telescopic extension from FIG. 5 in a retracted state.

FIG. 8 shows the driven telescopic extension 15 with the receptacle for items to be washed 13 in a retracted state. If the motor 31 is operated for example by a user via an operating element or automatically, this will cause the shaft 32 of the motor 31 to move rotationally and cause torque to be transmitted to the shaft 32 of the motor 31. The shaft 32 of the motor 31 transmits the torque and the rotational movement to the pinion 33. Because the pinion 33 engages with the toothed rack 28 of the carrier element 23, the rotational movement of the pinion 33 is converted into a translational movement of the carrier element 23. The coupling element 16 is extended out of the dishwasher cavity 2. As a result, the toothed rack 44 drives the drive-side toothed wheel 39 of the gear unit 34. In other words, the translational movement of the coupling element 16 is converted into a rotational movement of the toothed wheel 39. The toothed wheel 39 in FIG. 7, via the shaft 40, drives the toothed wheel 35 and thus the toothed wheels 36 to 38 on the other side of the carrier element 23. Here, the toothed wheels 35 and 37 rotate in the opposite direction to the toothed wheels 36 and 38. The toothed wheel 38 must rotate in an opposite direction to the toothed wheel 38 so that the receptacle for items to be washed 13 is extended out of the dishwasher cavity 2. The output-side toothed wheel 38 of the gear unit 34 drives the toothed rack 41 and converts the rotational movement of the toothed wheel 38 back into a translational movement. As a result, the rail 18 with the receptacle for items to be washed 13 is extended out of the dishwasher cavity 2.

A direct active connection between the coupling element 16 and the receptacle for items to be washed 13 causes the coupling element 16 and the receptacle for items to be washed 13 to be shifted simultaneously.

Figure 9:
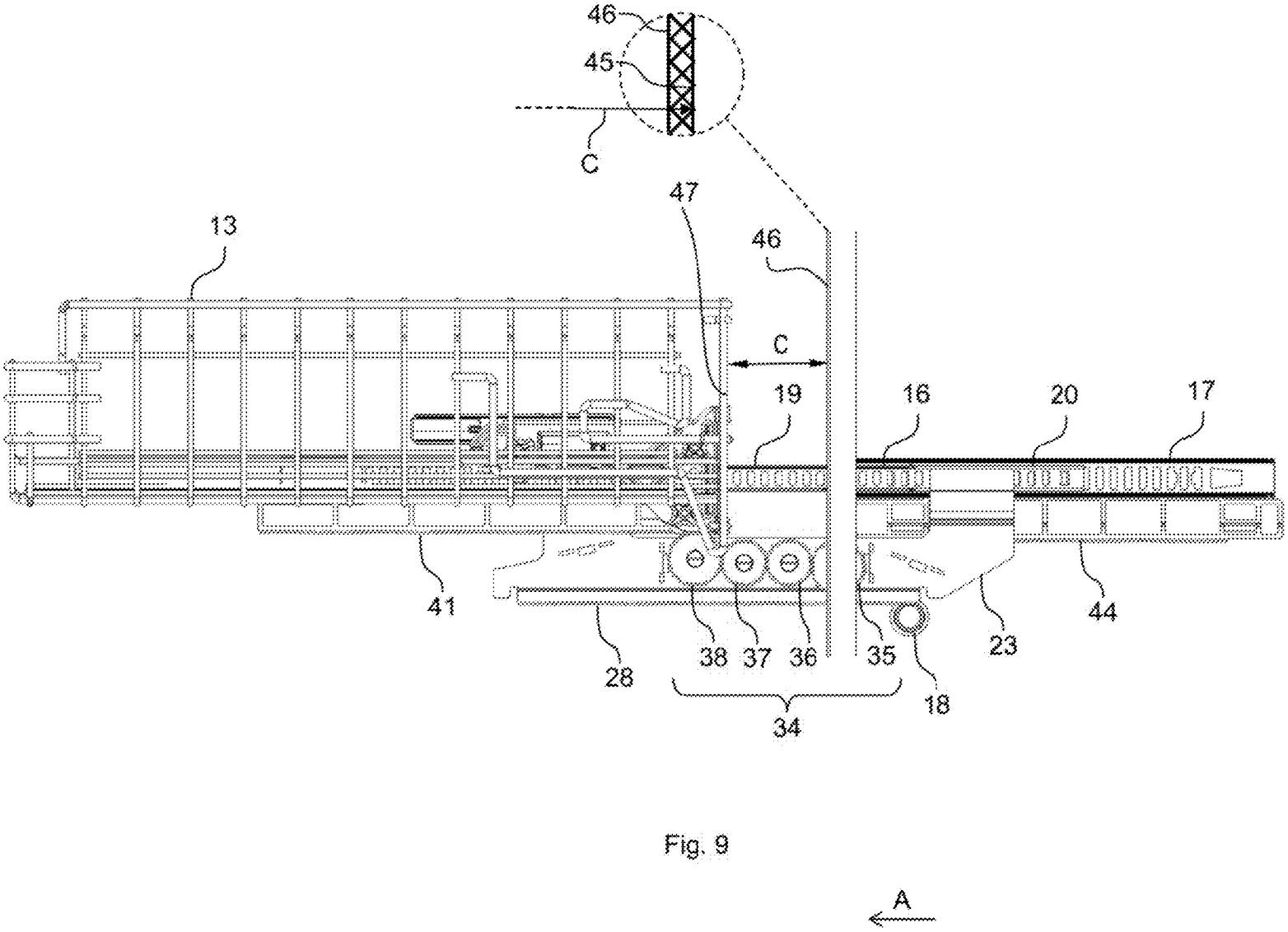
FIG. 9 shows a side view of the telescopic extension from FIG. 5 in an extended state with respect to a circumferential flange of a dishwasher cavity.

FIG. 9 shows the driven telescopic extension 15 with the receptacle for items to be washed 12 in an extended state with a circumferential flange 45 of the dishwasher cavity 2, which flange delimits the front-side loading opening 6. A seal 46, on which the door 3 rests in the closed state of the dishwasher cavity 2, is attached to the circumferential flange 45. As FIG. 9 further shows, a rear wall 47 of the receptacle for items to be washed 13 is spaced apart from the flange 45 of the dishwasher cavity 2. The rear wall 47 of the receptacle for items to be washed 13 is a basket side wall, which is formed in particular from rods or wires of the receptacle for items to be washed 13.

The distance between the rear wall 47 of the receptacle for items to be washed 13 and the flange 45 of the dishwasher cavity 2 is designated with C in FIG. 9. The distance C can be for example 10 cm or more. As described above, the distance C can be increased by a greater diameter of the toothed wheels 35 to 38 and/or with additional toothed wheels, which are arranged between the toothed wheels 35 to 38.

In a further exemplary embodiment, the coupling element 16 can be driven via belts, such as for example toothed belts or V-belts. In a further exemplary embodiment, the coupling element 16 can be driven via cables and deflection rollers.

In a further exemplary embodiment, the driven telescopic extension 15 from FIG. 9 can be preassembled. In a further assembly step, it can be fastened to the inside of the dishwasher cavity 2.

Although the present invention has been described with reference to exemplary embodiments, it can be modified in numerous different ways.

The invention claimed is:

1. A household dishwasher, comprising:

a dishwasher cavity;

a coupling element designed to be shifted into and at least partially out of the dishwasher cavity;

a receptacle for items to be washed, the receptacle designed to be shifted with respect to the coupling element in and against an extension direction between a retracted and extended state of the receptacle;

a drive designed to drive the coupling element in order to shift the coupling element into and out of the dishwasher cavity; and a telescopic extension of which the coupling element is part of, wherein the telescopic extension comprises a fixed section, which is fastened to the dishwasher cavity, and a movable section, which is fastened to the receptacle, the coupling element designed to couple the fixed section to the movable section, with the coupling element being displaceable with respect to the fixed section and with the movable section being displaceable with respect to the coupling element, and wherein rails of the coupling element, the fixed section, and the movable section are designed for displacement into one another telescopically.

2. The household dishwasher of claim 1, wherein the receptacle is shifted in the extended state so far out of the dishwasher cavity that the receptacle is spaced apart from the dishwasher cavity in the extension direction.

3. The household dishwasher of claim 1, further comprising a carrier element fastened to the coupling element, said carrier element including a gear unit which has a drive side and an output side, wherein the drive side is actively connected to the fixed section so that the fixed section drives the gear unit when the coupling element is shifted in and out.

4. The household dishwasher of claim 3, wherein the output side of the gear unit is actively connected to the movable section in order to shift the receptacle between the retracted state and the extended state.

5. The household dishwasher of claim 3, wherein the fixed section includes a toothed rack designed to engage into a toothed wheel of the drive side of the gear unit, and/or the carrier element includes a toothed rack designed to engage into a toothed wheel of the drive, and/or the receptacle includes a toothed rack designed to engage into a toothed wheel of the output side of the gear unit.

6. The household dishwasher of claim 3, wherein the gear unit includes at least two, four or six toothed wheels, which are arranged mechanically in series.

7. The household dishwasher of claim 5, further comprising a retainer fastened to the movable section, wherein the receptacle and the toothed rack of the receptacle are fastened to the retainer.

8. The household dishwasher of claim 1, wherein the coupling element and the receptacle shift simultaneously.

9. The household dishwasher of claim 1, wherein the drive includes an electric motor, which is arranged outside the dishwasher cavity and includes a shaft designed to project into the dishwasher cavity, with a toothed wheel of the drive being fastened to the shaft.

10. The household dishwasher of claim 3, wherein the carrier element includes two arms designed to fasten the carrier element to opposite sides of the coupling element.

11. The household dishwasher of claim 3, wherein the rails of the coupling element includes two C-shaped profiles, which are fastened to one another back to back and are connected offset with respect to one another in a longitudinal direction, wherein the carrier element includes two arms designed to fasten the carrier element to opposite sides of the coupling element, with the opposite sides of the coupling element being embodied at free ends of the rails of the coupling element.

12. The household dishwasher of claim 3, wherein the drive side is actively connected to the fixed section using a cable, a toothed belt, or a V-belt.

13. The household dishwasher of claim 1, wherein the coupling element couples the fixed section to the movable section, and wherein the fixed section is fastened to a side wall of the dishwasher cavity.

14. The household dishwasher of claim 1, wherein the coupling element is displaceable in a longitudinal direction with respect to the fixed section, and wherein the movable section is displaceable in the longitudinal direction with respect to the coupling element.

15. The household dishwasher of claim 10, wherein the carrier element comprises an elongated shape positioned in a longitudinal direction, and wherein the two arms extend in a height direction and couple the carrier element with the coupling element.

16. The household dishwasher of claim 15, wherein a first arm of the two arms is coupled with a first rail of the coupling element and wherein a second arm of the two arms is coupled with a second rail of the coupling element.

* * * * *